US011067929B2

(12) United States Patent
Murata et al.

(10) Patent No.: US 11,067,929 B2
(45) Date of Patent: Jul. 20, 2021

(54) FIXER AND IMAGE FORMING DEVICE

(71) Applicant: BROTHER KOGYO KABUSHIKI KAISHA, Nagoya (JP)

(72) Inventors: Satoshi Murata, Nagoya (JP); Yutaka Kakigahara, Nagoya (JP); Jun Mihara, Nagoya (JP); Masamitsu Takahashi, Nagoya (JP); Kengo Takeda, Tokai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/032,459

(22) Filed: Sep. 25, 2020

(65) Prior Publication Data

US 2021/0011407 A1 Jan. 14, 2021

Related U.S. Application Data

(63) Continuation of application No. PCT/JP2018/047487, filed on Dec. 25, 2018.

(30) Foreign Application Priority Data

Mar. 30, 2018 (JP) ..... 2018-068352

(51) Int. Cl.
*G03G 15/20* (2006.01)
*G03G 15/10* (2006.01)

(52) U.S. Cl.
CPC ..... *G03G 15/2096* (2013.01); *G03G 15/104* (2013.01)

(58) Field of Classification Search
CPC ..... G03G 15/2096; G03G 15/104
See application file for complete search history.

(56) References Cited

U.S. PATENT DOCUMENTS

2008/0069612 A1* 3/2008 Nakamura ..... G03G 15/2064 399/340
2011/0222924 A1 9/2011 Aoyama et al.
(Continued)

FOREIGN PATENT DOCUMENTS

JP 2005-315947 11/2005
JP 2008-65190 A 3/2008
(Continued)

OTHER PUBLICATIONS

International Search Report for International Application No. PCT/JP2018/047487 dated Feb. 26, 2019 5 pages.
(Continued)

*Primary Examiner* — Walter L Lindsay, Jr.
*Assistant Examiner* — Jessica L Eley
(74) *Attorney, Agent, or Firm* — Merchant & Gould P.C.

(57) ABSTRACT

There is provided a fixing apparatus configured to fix a toner image on a print medium by spraying a fixing solution, the fixing apparatus including: a plurality of first nozzles from which the fixing solution is sprayed, a first electrode which extends in a first direction, and which faces the first nozzles in a second direction, a holding groove which accommodates the first electrode, which is configured to hold the fixing solution sprayed from the first nozzles, and which has a discharge port through, and a container configured to contain the fixing solution discharged from the discharge port. The holding groove has a bottom surface which is positioned apart from the first electrode in the second direction so that the fixing solution held in the holding groove passes between the first electrode and the bottom surface to flow toward the discharge port.

13 Claims, 5 Drawing Sheets

(56) References Cited

U.S. PATENT DOCUMENTS

| | | | | |
|---|---|---|---|---|
| 2018/0217543 | A1* | 8/2018 | Kakigahara | G03G 15/50 |
| 2019/0055665 | A1* | 2/2019 | Banik, II | C25D 17/005 |

FOREIGN PATENT DOCUMENTS

| | | |
|---|---|---|
| JP | 2011-186235 | 9/2011 |
| JP | 2012-159631 | 8/2012 |
| JP | 2017-68098 A | 4/2017 |
| JP | 2017-68103 A | 4/2017 |

OTHER PUBLICATIONS

Written Opinion issued in corresponding International Patent Application No. PCT/JP2018/047487, dated Feb. 26, 2019.

* cited by examiner

FIXER AND IMAGE FORMING DEVICE

CROSS-REFERENCE TO RELATED APPLICATIONS

This application is a Continuation Application of International Application No. PCT/JP2018/047487 claiming the conventional priority of Japanese patent Application No. 2018-068352 filed on Mar. 30, 2018, and titled "FIXER AND IMAGE FORMING DEVICE". The disclosures of Japanese patent Application No. 2018-068352 and International Application No. PCT/JP2018/047487 are incorporated herein by reference in their entirety.

BACKGROUND

The present disclosure relates to a fixer (fixing apparatus) an image forming device (image forming apparatus).

There is conventionally known a fixing apparatus configured to fix a toner image on a print medium by spraying a fixing solution onto the print medium on which the toner image is formed (see, Japanese Patent Application Laid-open No. 2017-68098). The fixing apparatus includes a plurality of nozzles from which the fixing solution is sprayed and an electrode facing the nozzles. Voltage is applied to the nozzles and the electrode. The fixing solution sprayed from the nozzles is attracted toward the electrode by electrostatic force. In this configuration, when the print medium on which the toner image is formed is conveyed between the nozzles and the electrode, the fixing solution is sprayed from the nozzles toward the print medium on which the toner image is formed.

SUMMARY

In the fixing apparatus described in Japanese Patent Application Laid-open No. 2017-68098, in order to inhibit the clogging of nozzles, the fixing solution may be sprayed from the nozzles in the absence of the print medium between the nozzles and the electrode. In that case, the fixing solution sprayed from the nozzles accumulates around the electrode.

In view of the above, an object of the present disclosure is to provide a fixing apparatus and an image forming apparatus that can recover or collect a fixing solution sprayed from a plurality of nozzles.

(1) A fixing apparatus of the present disclosure fixes a toner image on a print medium by spraying a fixing solution on the print medium on which the toner image is formed (the print medium with the toner image formed thereon). The fixing apparatus includes a plurality of first nozzles, a first electrode, a holding groove, and a container.

The fixing solution is sprayed from the plurality of first nozzles to the print medium on which the toner image is formed. Voltage is applied to the plurality of first nozzles.

Voltage is applied to the first electrode. The first electrode extends in a first direction. The first electrode faces the plurality of first nozzles in a second direction. The first electrode is positioned apart from the plurality of first nozzles in the second direction.

The holding groove accommodates the first electrode. The holding groove holds the fixing solution sprayed from the plurality of first nozzles. The holding groove has a discharge port. The fixing solution held in the holding groove is discharged through the discharge port.

The container is connected to the discharge port and contains the fixing solution discharged from the discharge port.

The holding groove has a bottom surface. The bottom surface is positioned on an opposite side of the first nozzles with respect to the first electrode in the second direction. The bottom surface is positioned apart from the first electrode in the second direction so that the fixing solution held in the holding groove passes between the first electrode and the bottom surface to flow toward the discharge port.

According to such a configuration, the first electrode faces the plurality of first nozzles. The first electrode is positioned in the holding groove.

Thus, the fixing solution sprayed from the first nozzle(s) be guided into the holding groove by the first electrode and held in the holding groove.

Further, the bottom surface of the holding groove is separated from the first electrode in the second direction.

Thus, the fixing solution held in the holding groove can flow toward the discharge port through the space between the first electrode and the bottom surface, and can be contained in the container via the discharge port.

This makes it possible to recover or collect the fixing solution sprayed from the plurality of nozzles.

(2) An image forming apparatus of the present disclosure may include the fixing apparatus and a photosensitive drum. The photosensitive drum is rotatable about an axis extending in the first direction. The discharge port is positioned on an opposite side of the photosensitive drum with respect to the first electrode.

DESCRIPTION OF EMBODIMENTS

1. Outline of Image Forming Apparatus

Figure 1:
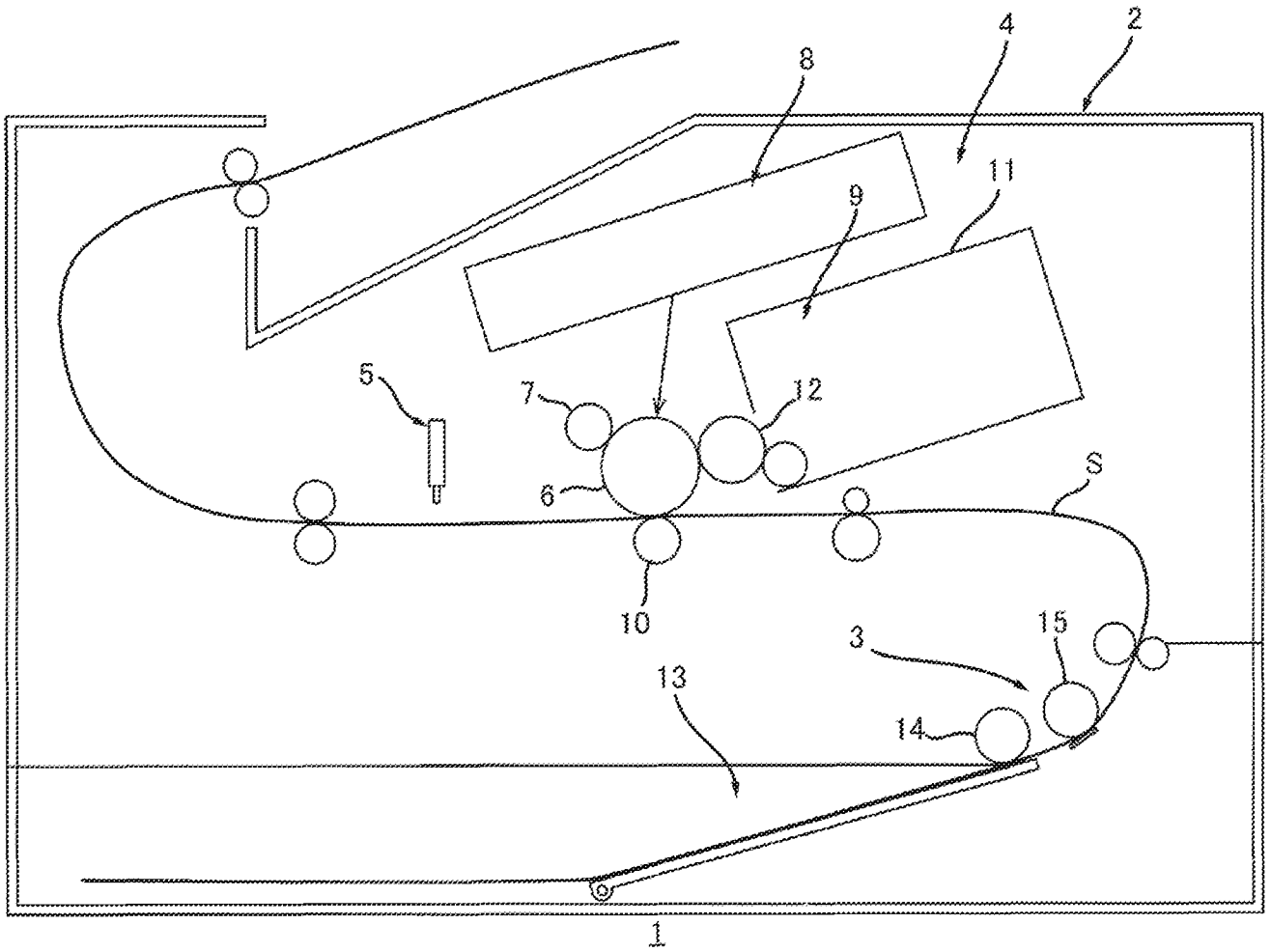
FIG. 1 depicts a schematic configuration of an image forming apparatus.

A schematic configuration of an image forming apparatus 1 is explained with reference to FIG. 1.

The image forming apparatus 1 includes a body casing 2, a feeder 3, a toner image forming section 4, and a fixing apparatus 5.

1.1 Body Casing

The body casing 2 configures the exterior of the image forming apparatus 1. The body casing 2 houses the feeder 3, the toner image forming section 4, and the fixing apparatus 5.

1.2 Feeder

The feeder 3 is configured to supply or feed a print medium S to the toner image forming section 4. Specifically, the feeder 3 is configured to convey the print medium S toward a photosensitive drum 6 of the toner image forming section 4. The toner image forming section 4 is explained below. The feeder 3 includes a paper feed bay 13, a pick-up roller 14, and a paper feed roller 15. The paper feed tray 13 is configured to accommodate the print medium S. The print medium S is, for example, printing paper (printing sheet). The pick-up roller 14 is configured to convey the print medium S in the paper feed tray 13 toward the paper teed roller 15. The paper feed roller 15 is configured to convey the print medium S fed from the pick-up roller 14 toward the photosensitive drum 6.

1.3 Toner Image Forming Section

The toner image forming section 4 is configured to form a toner image on the print medium S by use of a toner. The toner image forming section 4 includes the photosensitive drum 6, a charger 7, an exposure apparatus 8, a developing apparatus 9, and a transfer apparatus 10. Namely, the image forming apparatus 1 includes the photosensitive drum 6.

The photosensitive drum 6 has a cylindrical shape. The photosensitive drum 6 is rotatable about a shaft or axis extending in a first direction. The first direction is explained below.

The charger 7 is configured to charge a surface of the photosensitive drum 6. The charger 7 is, for example, a charging roller. The charger 7 may be a scorotron type charger. When the charger 7 is the charging roller, the charger 7 comes into contact with the surface of the photosensitive drum 6. When the charger 7 is the scorotron type charger, the charger 7 is positioned apart from the surface of the photosensitive drum 6.

The exposure apparatus 8 is configured to expose the surface of the photosensitive drum 6. Specifically, the exposure apparatus 8 is configured to expose the surface of the photosensitive drum 6 charged by the charger 7. As a result, an electrostatic latent image is formed on the surface of the photosensitive drum 6. The exposure apparatus 8 is, specifically, a laser scan unit. The exposure apparatus 8 may be an LED array.

The developing apparatus 9 is configured to supply the toner to the surface of the photosensitive drum 6. This develops the electrostatic latent image to form the toner image on the surface of the photosensitive drum 6. The developing apparatus 9 includes a toner accommodating section 11 and a developing roller 12.

The toner accommodating section 11 accommodates the toner. The toner has toner particles and as needed, an external additive. The toner particles have a binder resin, and as necessary, a colorant, a pigment dispersant, a mold releasing agent, a magnetic body, and a charging control agent. The binder resin is a base of the toner particles. The binder resin binds components in the toner particles. The binder resin is softened by application of a fixing solution thereto, and then is cured to be firmly fixed to the print medium S. The colorant imparts a desired color to the toner particles. The colorant is dispersed in the binder resin. The pigment dispersant improves the dispersibility of the colorant. The charging control agent imparts a charging property (chargeability) to the toner particles. The chargeability may be either positive chargeability or negative chargeability. The external additive adjusts the chargeability, fluidity, storage stability of the toner particles.

The developing roller 12 is configured to supply the toner in the toner accommodating section 11 to the surface of the photosensitive drum 6. The developing roller 12 comes into contact with the photosensitive drum 6. The developing roller 12 may not come into contact with the photosensitive drum 6.

The developing apparatus 9 may be configured as one process unit together with the photosensitive drum 6 and the charger 7. The process unit may be attachable to the body casing 2.

Further, the developing apparatus 9 may be a developing cartridge attachable to a drum unit having the photosensitive drum 6 and the charger 7. The drum unit may be attachable to the body casing 2.

Further, the developing apparatus 9 may include a developing section that includes the developing roller 12, and a toner cartridge that is attachable to the developing section. In such a case, the toner cartridge is provided with the toner accommodating section 11. Further, the developing section may be provided in the drum unit. The developing section may be attachable to the drum unit.

The transfer apparatus 10 is configured to transfer the toner image from the photosensitive drum 6 to the print medium S. The toner image is thus formed on the print medium S. The transfer apparatus 10 comes into contact with the photosensitive drum 6. The transfer apparatus 10 may not come into contact with the photosensitive drum 6. The transfer apparatus 10 is, specifically, a transfer roller. The transfer apparatus 10 may be a transfer belt.

1.4 Fixing Apparatus

The fixing apparatus 5 sprays the fixing solution onto the print medium S, on which the toner image is formed, to fix the toner image to the print medium S. The print medium S on which the toner image is fixed is discharged onto an upper surface of the body casing 2.

2. Details of Fixing Apparatus

Figure 2:
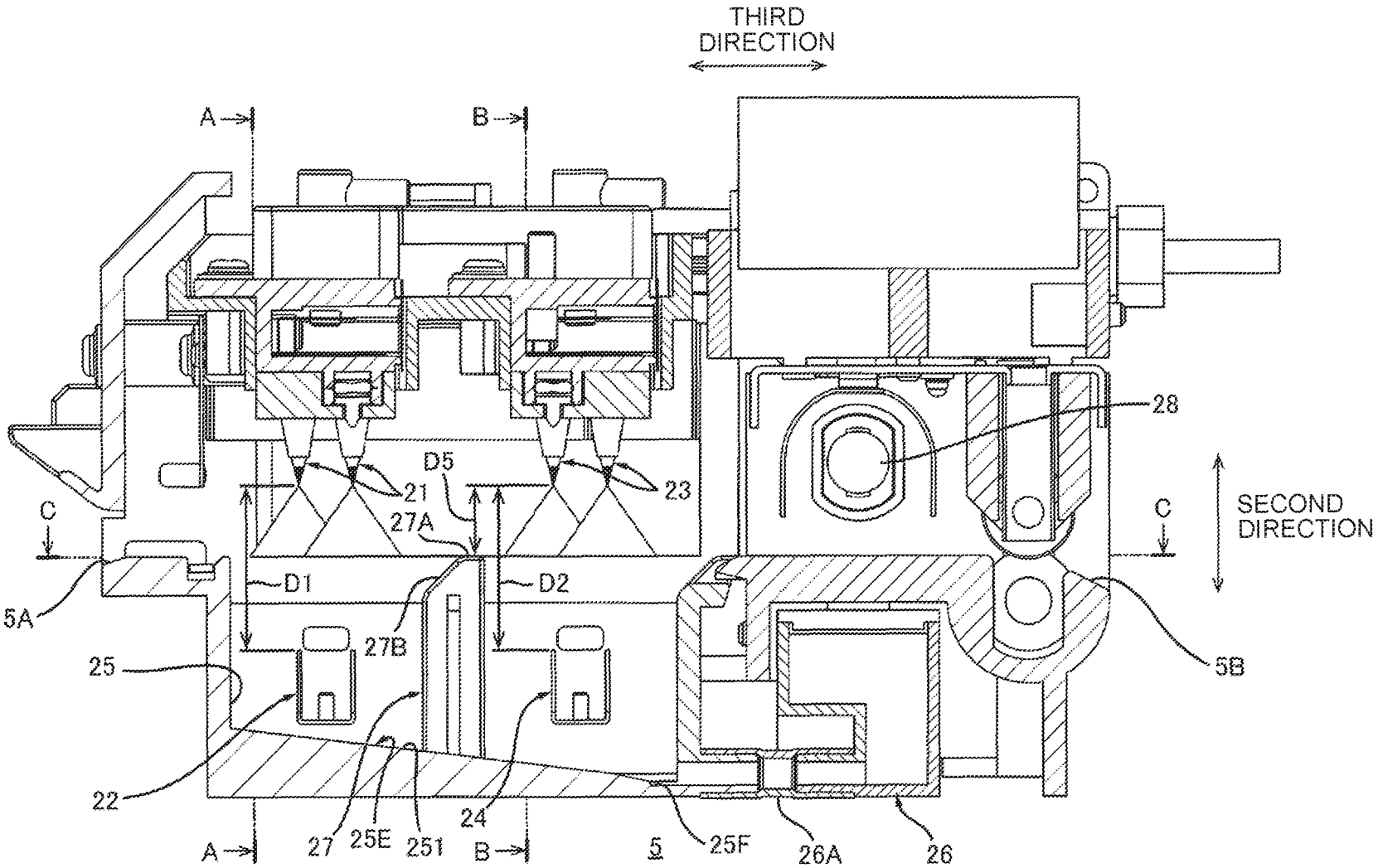
FIG. 2 is a cross-sectional view of a center portion of a fixing apparatus.
Figure 3:
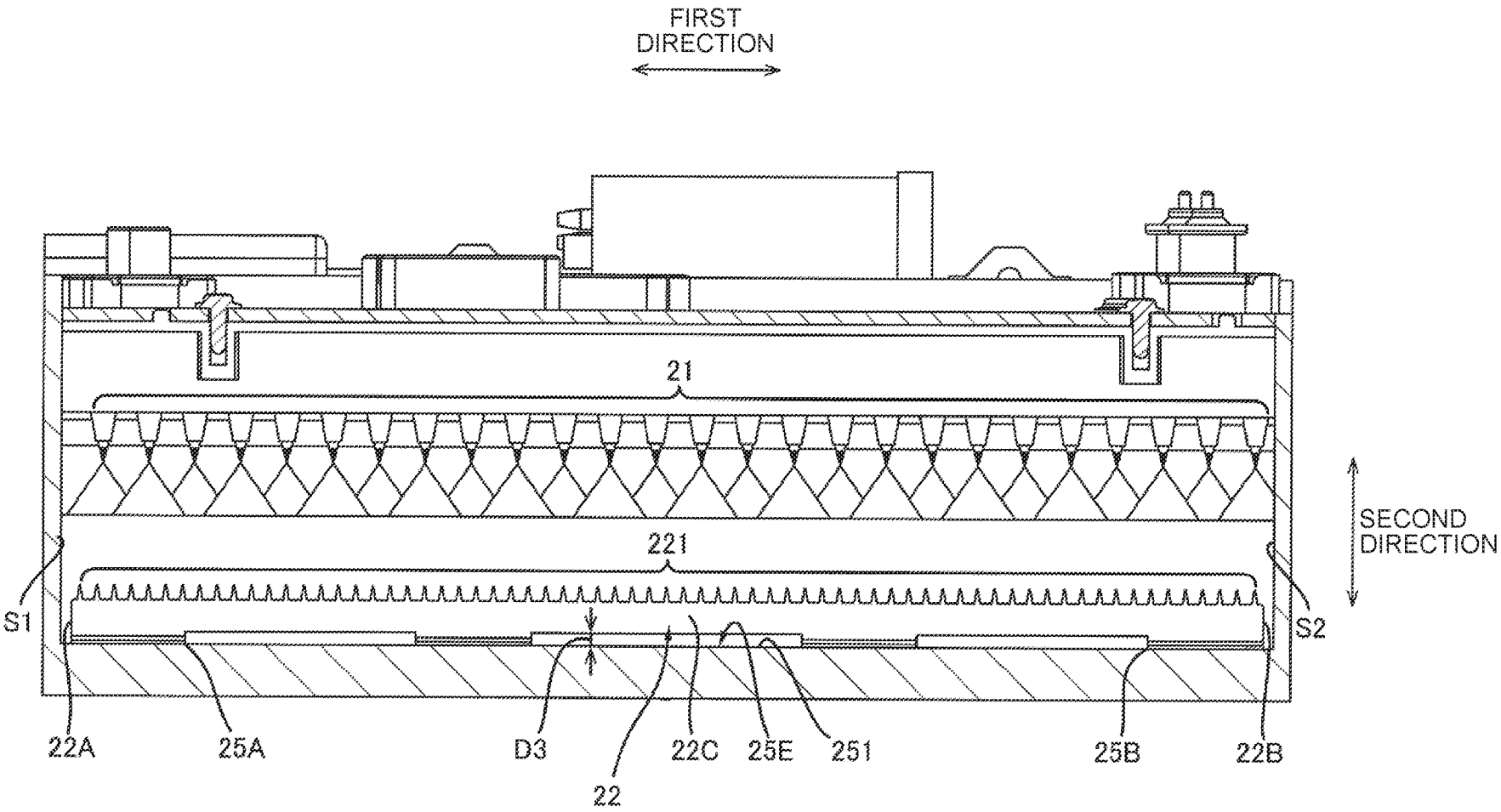
FIG. 3 is a cross-sectional view of the fixing apparatus depicted in FIG. 2 that is taken along a line A-A.
Figure 4:
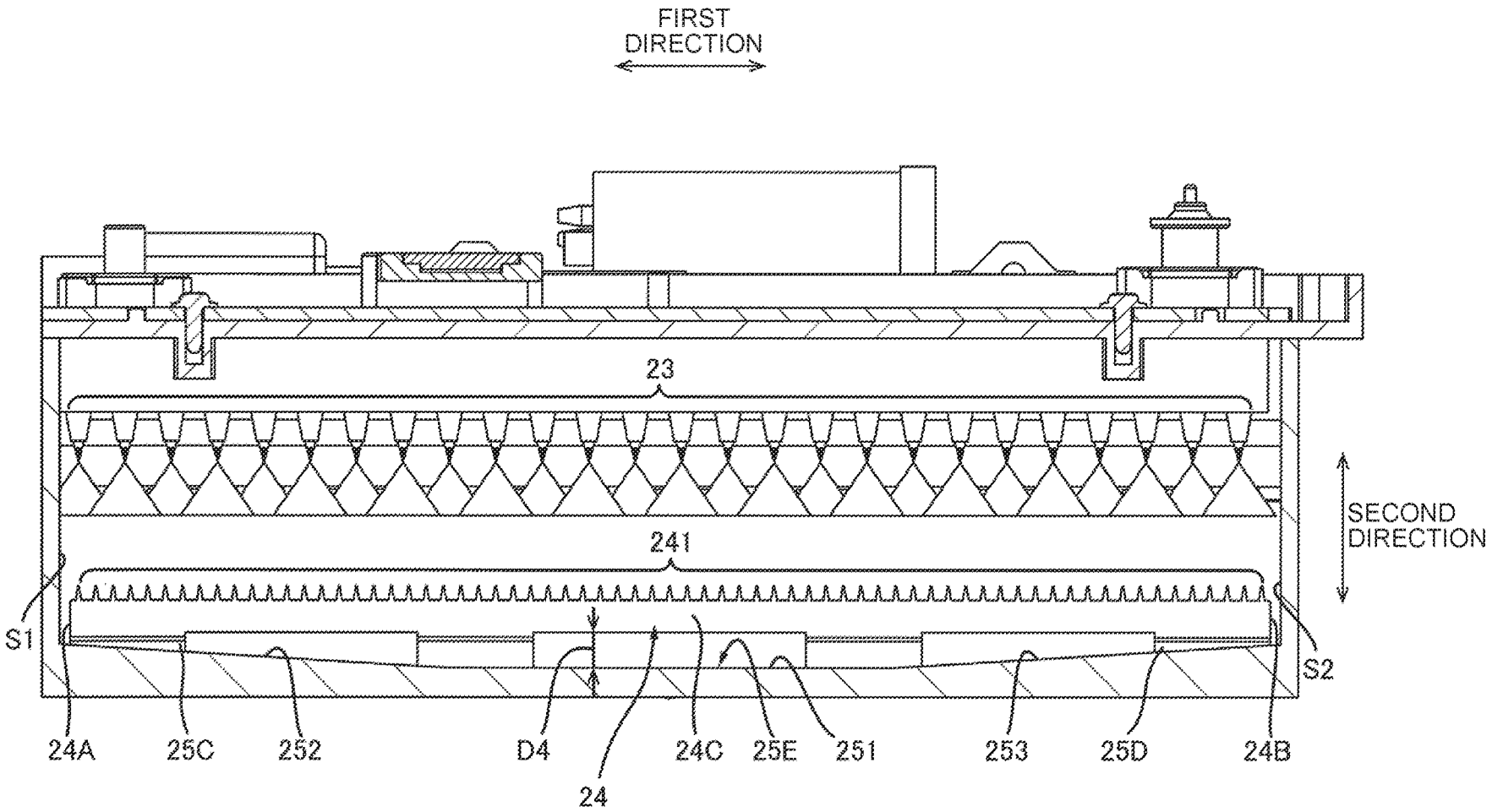
FIG. 4 is a cross-sectional view of the fixing apparatus depicted in FIG. 2 that is taken along a line B-B.

Referring to FIGS. 2 to 4, details of the fixing apparatus 5 are described below.

As depicted in FIG. 2, the fixing apparatus 5 has an inlet 5A and an outlet 5B. The inlet 5A is an opening through which the print medium S enters the fixing apparatus 5. The inlet 5A may be provided with a discharging member (destaticizing member) for removing the charge of the print medium S. The outlet 5B is an opening through which the print medium S exits from the fixing apparatus 5. In this embodiment, the outlet 5B is positioned apart from the inlet 5A in a third direction. The third direction is explained below.

The fixing apparatus 5 further includes a plurality of first nozzles 21, a first electrode 22, a plurality of second nozzles 23, a second electrode 24, a holding groove 25, a container 26, a rib 27, and a heater 28.

2.1 First Nozzles

The fixing solution is sprayed from each of the first nozzles 21 onto the print medium S on which the toner image is formed. Voltage is applied to each of the first nozzles 21. The fixing solution is thus electrostatically sprayed from each of the first nozzles 21.

As depicted in FIG. 3, the first nozzles 21 are arranged in the first direction. Specifically, the first nozzles 21 are arranged zigzag. Each of the first nozzles 21 extends in a second direction toward the first electrode 22. The second direction is a direction in which each of the first nozzles 21 faces the first electrode 22. Each of the first nozzles 21 has a conical shape.

2.2 First Electrode

As depicted in FIG. 2, the first electrode 22 faces each of the first nozzles 21 in the second direction. The first electrode 22 is positioned apart from each of the first nozzles 21 in the second direction.

As depicted in FIG. 3, the first electrode 22 extends in the first direction. The first electrode 22 has one end (first end) 22A in the first direction, the other end (second end) 22B in the first direction, and a first intermediate portion 22C. The other end 22B is positioned apart from the one end 22A in the first direction. The first intermediate portion 22C is positioned between the one end 22A and the other end 22B in the first direction.

Voltage is applied to the first electrode 22. As a result, the fixing solution sprayed from each of the first nozzles 21 can be attracted toward the first electrode 22 by electrostatic force. Specifically, the first electrode 22 has a plurality of protrusions 221. The protrusions 221 are arranged in the first direction at intervals. Each of the protrusions 221 extends in the second direction. Each of the protrusions 221 extends toward the first nozzles 21. When voltage is applied to the first electrode 22, the electrostatic force concentrates at the tip of each of the protrusions 221. Thus, the fixing solution sprayed from each of the first nozzles 21 can be reliably attracted toward the first electrode 22.

The print medium S passing through the fixing apparatus 5 passes between each of the first nozzles 21 and the first electrode 22. Thus, when the print medium S passes through the fixing apparatus 5, the fixing solution heading the first electrode 22 from each of the first nozzles 21 is applied to the print medium S.

2.3 Second Nozzles

As depicted in FIG. 2, the fixing solution is sprayed from each of the second nozzles 23 onto the print medium S on which the toner image is formed. Voltage is applied to each of the second nozzles 23. The second nozzles 23 are positioned apart from the first nozzles 21 in the third direction. The third direction is orthogonal to the first direction and the second direction. The third direction is a direction directed from the inlet 5A toward the outlet 5B. The second nozzles 23 are positioned between the first nozzles 21 and the discharge port 25F in the third direction. The discharge port 25F is described below. Further, the second nozzles 23 are positioned closer to the outlet 5B than the first nozzles 21 in the third direction.

As depicted in FIG. 4, the second nozzles 23 are arranged in the first direction. Specifically, the second nozzles 23 are arranged zigzag. Each of the second nozzles 23 extends in the second direction toward the second electrode 24. The second direction is a direction in which each of the second nozzles 23 faces the second electrode 24. Each of the second nozzles 23 has a conical shape.

2.4 Second Electrode

As depicted in FIG. 2, the second electrode 24 is positioned between the first electrode 22 and the discharge port 25F in the third direction. The second electrode 24 is positioned closer to the outlet 5B than the first electrode 22 in the third direction. The second electrode 24 faces each of the nozzles 23 in the second direction. The second electrode 24 is positioned apart from each of the second nozzles 23 in the second direction.

Preferably, a distance D2 between the second electrode 24 and the second nozzles 23 in the second direction is the same as a distance D1 between the first electrode 22 and the first nozzles 21 in the second direction.

As depicted in FIG. 4, the second electrode 24 extends in the first direction. The second electrode 24 has one end (first end) 24A in the first direction, the other end (second end) 24B in the first direction, and a second intermediate portion 24C. The other end 24B is positioned apart from the one end 24A in the first direction. The second intermediate portion 24C is positioned between the one end 24A and the other end 24B in the first direction.

Voltage is applied to the second electrode 24. As a result, the fixing solution sprayed from each of the second nozzles 23 can be attracted toward the second electrode 24 by electrostatic force. Specifically, the second electrode 24 has a plurality of protrusions 241. The protrusions 241 are arranged in the first direction at intervals. Each of the projections 241 extends in the second direction. Each of the protrusions 241 extends toward the second nozzles 23. When voltage is applied to the second electrode 24, the electrostatic force concentrates at the tip of each of the protrusions 241. Thus, the fixing solution sprayed from each of the second nozzles 23 can be reliably attracted toward the second electrode 24.

The print medium S passing through the fixing apparatus 5 passes between each of the first nozzles 21 and the first electrode 22, and then passes between each of the second nozzles 23 and the second electrode 24. Thus, when the print medium S passes through the fixing apparatus 5, the fixing solution heading the second electrode 24 from each of the second nozzles 23 is also applied to the print medium S.

2.5 Holding Groove

As depicted in FIG. 2, the holding groove 25 accommodates the first electrode 22 and the second electrode 24. As a result, the fixing solution sprayed from the first nozzles 21 is attracted to the first electrode 22 and held in the holding groove 25. The fixing solution sprayed from the second nozzles 23 is attracted to the second electrode 24 and held in the holding groove 25. Namely, the holding groove 25 holds the fixing solution sprayed from the first nozzles 21 and the fixing solution sprayed from the second nozzles 23. The holding groove 25 is recessed in the second direction, away from the first nozzles 22 and the second nozzles 23. An edge of the holding groove 25 is chamfered.

As depicted in FIGS. 3 and 4, the holding groove 25 has a first support portion 25A (see FIG. 3), a second support portion 25B (see FIG. 3), a third support portion 25C (see FIG. 4), a fourth support portion 25D (see FIG. 4), a bottom surface 25E, and the discharge port 25F.

2.5.1 First Support Portion and Second Support Portion

As depicted in FIG. 3, the first support portion 25A and the second support portion 25B are positioned in the holding groove 25. The first support portion 25A and the second support portion 25B support the first electrode 22.

In this embodiment, the first support portion 25A supports the one end 22A of the first electrode 22 in the first direction. The second support portion 25B supports the other end 22B of the first electrode 22 in the first direction. The first support portion 25A may not support the one end 22A of the first electrode 22 in the first direction, and the second support portion 25B may not support the other end 22B of the first electrode 22 in the first direction. The first support portion 25A may support a portion (first portion) of the first electrode 22 in the first direction, and the second support portion 25B may support a portion (second portion) of the first electrode 22 in the first direction that is positioned apart from the first support portion 25A.

The first support portion 25A extends from the bottom surface 25E in the second direction. Further, the first support portion 25A extends in the first direction. The first support portion 25A may not extend from the bottom surface 25E in the second direction. The first support portion 25A may extend from a first side surface S1 of the holding groove 25 in the first direction.

The second support portion 25B is positioned apart from the first support portion 25A in the first direction. Similar to the first support portion 25A, the second support portion 259 extends from the bottom surface 25E in the second direction. Further, the second support portion 25B extends in the first direction. The second support portion 25B may not extend from the bottom surface 25E in the second direction. The second support portion 25B may extend from a second side surface S2 of the holding groove 25 in the first direction.

The first electrode 22 is positioned between each of the first nozzles 21 and the bottom surface 25E of the holding groove 25 in the second direction by being supported by the first support portion 25A and the second support portion 25B. Further, the first electrode 22 is positioned apart from the bottom surface 25E in the second direction by being supported by the first support portion 25A and the second support portion 25B. Specifically, the first intermediate portion 22C of the first electrode 22 is positioned apart from the bottom surface 25E in the second direction.

Accordingly, the fixing solution held in the holding groove 25 passes between the first electrode 22 and the bottom surface 25E, and flows toward the discharge port 25F.

2.5.2 Third Support Portion and Fourth Support Portion

As depicted in FIG. 4, the third support portion 25C and the fourth support portion 25D are positioned in the holding groove 25. The third support portion 25C and the fourth support portion 25D support the second electrode 24.

In this embodiment, the third support portion 25C supports the one end 24A of the second electrode 24 in the first direction. Further, the fourth support portion 25D supports the other end 24B of the second electrode 24 in the first direction. The third support portion 25C may not support the one end 24A of the second electrode 24 in the first direction, and the fourth support portion 25D may not support the other end 24B of the second electrode 24 in the first direction. The third support portion 25C may support a portion (first portion) of the second electrode 24 in the first direction, and the fourth support portion 25D may support a portion (second portion) of the second electrode 24 in the first direction that is positioned apart from the third support portion 25C.

The third support portion 25C extends from the bottom surface 25E in the second direction. Further, the third support portion 25C extends in the first direction. The third support portion 25C may not extend from the bottom surface 25E in the second direction. The third support portion 25C may extend from the first side surface S1 of the holding groove 25 in the first direction.

The fourth support portion 25D is positioned apart from the third support portion 25C in the first direction. Similar to the third support portion 25C, the fourth support portion 25D extends from the bottom surface 25E in the second direction. Further, the fourth support portion 25D extends in the first direction. The fourth support portion 25D may not extend from the bottom surface 25E in the second direction. The fourth support portion 25D may extend from the second side surface S2 of the holding groove 25 in the first direction.

The second electrode 24 is positioned between each of the second nozzles 23 and the bottom surface 25E of the holding groove 25 in the second direction by being supported by the third support portion 25C and the fourth support portion 25D. Further, the second electrode 24 is positioned apart from the bottom surface 25E in the second direction by being supported by the third support portion 25C and the fourth support portion 25D. Specifically, the second intermediate portion 24C of the second electrode 24 is positioned apart from the bottom surface 25E in the second direction.

Accordingly, the fixing solution held in the holding groove 25 passes between the second electrode 24 and the bottom surface 25E, and flows toward the discharge port 25F.

A distance D4 between the second intermediate portion 24C of the second electrode 24 and the bottom surface 25E in the second direction is longer than a distance D3 between the first intermediate portion 22C of the first electrode 22 and the bottom surface 25E in the second direction (see FIG. 3).

2.5.3 Bottom Surface

As depicted in FIG. 2, the bottom surface 25E is positioned on an opposite side of the first nozzles 21 with respect to the first electrode 22 in the second direction. The bottom surface 25E inclines downward in the third direction from the first electrode 22 toward the discharge port 25F. In other words, the bottom surface 25E is farther from the first nozzles 21 with distance from the first electrode 22. Since the bottom surface 25E inclines downward in the third direction from the first electrode 22 toward the discharge port 25F, the fixing solution held in the holding groove 25 can flow toward the discharge port 25F by gravitational force.

As depicted in FIG. 4, the bottom surface 25E inclines downward in the first direction. Specifically, the bottom surface 25E inclines downward in the first direction from the one end 24A toward the other end 24B of the second electrode 24. Further, the bottom surface 25E inclines downward in the first direction from the other end 24B toward the one end 24A of the second electrode 24.

Figure 5:
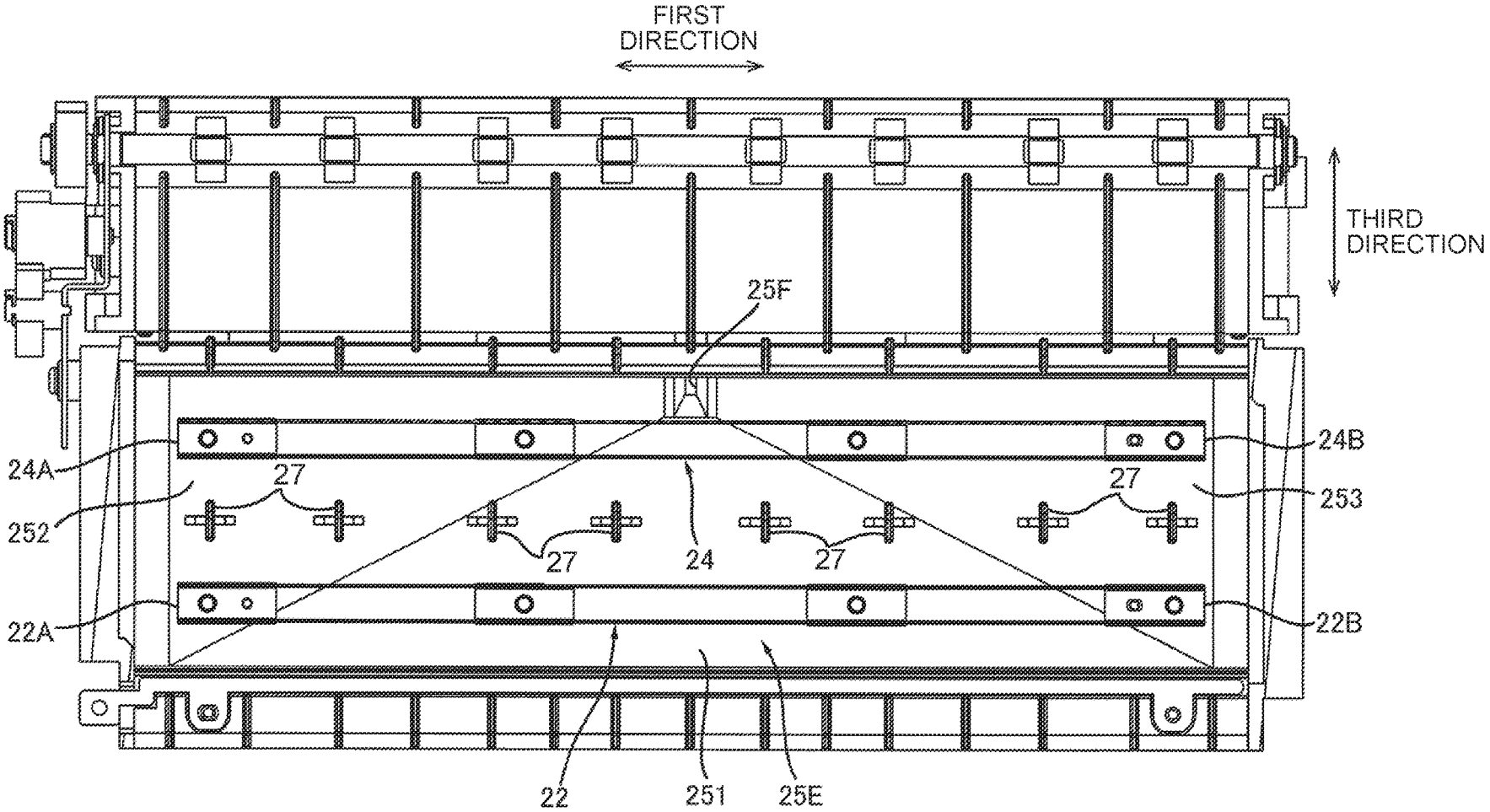
FIG. 5 is a cross-sectional view of the fixing apparatus depicted in FIG. 2 that is taken along a line C-C.

More specifically, as depicted in FIG. 5, the bottom surface 25E has a first inclined portion 251, a second inclined portion 252, and a third inclined portion 253.

The first inclined portion 251 is positioned between the second inclined portion 252 and the third inclined portion 253 in the first direction. The first inclined portion 251 inclines downward in the third direction from the first electrode 22 toward the container 26.

The second inclined portion 252 is connected to the first inclined portion 251. The second inclined portion 252 inclines downward in the first direction toward the first inclined portion 251. The second inclined portion 252 inclines downward in the first direction from the one end 24A toward the other end 24B of the second electrode 24.

The third inclined portion 253 is connected to the first inclined portion 251. The third inclined portion 253 inclines downward in the first direction toward the first inclined portion 251. The third inclined portion 253 inclines downward in the first direction from the other end 24B toward the one end 24A of the second electrode 24.

2.5.4 Discharge Port 25F

As depicted in FIG. 5, the fixing solution held in the holding groove 25 is discharged through the discharge port 25F.

Specifically, the fixing solution held in the holding groove 25 can be collected toward the discharge port 25F by the first inclined portion 251, the second inclined portion 252 and the third inclined portion 253. The collected fixing solution flows into the discharge port 25F.

The discharge port 25F is positioned at a center portion of the holding groove 25 in the first direction. The discharge port 25F is positioned apart from the first electrode 22 in the third direction. The discharge port 25F is positioned on an opposite side of the first electrode 22 with respect to the second electrode 24 in the third direction. The discharge port 25F is positioned closer to the outlet 5B than the first electrode 22 and the second electrode 24 in the third direction. Further, the discharge port 25F is positioned on an opposite side of the photosensitive drum 6 (see FIG. 1) with respect to the first electrode 22 in the third direction.

2.6 Container

As depicted in FIG. 2, the container 26 is positioned closer to the outlet 5B than the holding groove 25 in the third direction. Namely, the container 26 is positioned apart from the first electrode 22 in the third direction. The container 26 is positioned on the opposite side of the first electrode 22 with respect to the second electrode 24 in the third direction. Further, the container 26 is positioned on the opposite side of the photosensitive drum 6 (see FIG. 1) with respect to the first electrode 22 in the third direction. The container 26 is connected to the discharge port 25F. Specifically, the container 26 is connected to the discharge port 25F via a tube (pipe) 26A. The container 26 contains the fixing solution discharged from the discharge port 25F. The container 26 is removable from the fixing apparatus 5.

2.7 Rib

As depicted in FIG. 2, the rib 27 is positioned between the first electrode 22 and the second electrode 24 in the third direction. The rib 27 extends from the bottom surface 25E in the second direction. The rib 27 guides the print medium S. Specifically, the rib 27 has a first guide surface 27A and a second guide surface 27B. The first guide surface 27A extends in the third direction. The first guide surface 27A supports the print medium S passing through the fixing apparatus 5 in the second direction. As a result, the first guide surface 27A guides movement of the print medium S in the third direction. The second guide surface 27B is positioned closer to the inlet 5A than the first guide surface 27A in the third direction. The second guide surface 27B is inclined to the third direction. A part of the second guide surface 27B closer to the outlet 5B is farther in the third direction from the bottom surface 25E than a part of the second guide surface 27B closer to the inlet 5A. The second guide surface 27B is connected to the first guide surface 27A. The second guide surface 27B guides an end of the print medium S toward the first guide surface 27A.

A distance D5 between the first nozzles 21 and the rib 27 in the second direction is shorter than the distance D1 between the first nozzles 21 and the first electrode 22 in the second direction. The distance D5 between first nozzles 21 and the rib 27 in the second direction is shorter than the distance D2 between the second nozzles 23 and the second electrode 24 in the second direction.

Thus, the rib 27 can guide the print medium S between the first nozzles 21 and the first electrode 22 in the second direction, and between the second nozzles 23 and the second electrode 24 in the second direction.

As depicted in FIG. 5, the rib 27 includes a plurality of ribs arranged in the first direction.

The edges of the ribs 27 are chamfered.

2.8 Heater

As depicted in FIG. 2, the heater 28 is positioned between the first nozzles 21, the second nozzles 23 and the outlet 5B in the third direction. The heater 28 heats the print medium S on which the toner image is formed and to which the fixing solution is applied. As a result, the toner formed on the print medium S is fixed to the print medium S more quickly. A conveying roller may be provided between the first nozzles 21, the second nozzles 23 and the heater 28 in the third direction.

3. Operation and Effect

As depicted in FIG. 2, in the fixing apparatus 5, the first electrode 22 faces the first nozzles 21. The first electrode 22 is accommodated in the holding groove 25.

Thus, the fixing solution sprayed from the first nozzles 21 can be guided into the holding groove 25 by the first electrode 22 and held in the holding groove 25.

Further, as depicted in FIG. 3, the bottom surface 25E of the holding groove 25 is positioned apart from the first electrode 22 in the second direction.

Specifically, the first electrode 22 is positioned apart from the bottom surface 25E by being supported by the first support portion 25A and the second support portion 25B.

Thus, the fixing solution held in the holding groove 25 can flow toward the discharge port 25F through the space between the first electrode 22 and the bottom surface 25E, and can be contained in the container 26 via the discharge port 25F.

This makes it possible to recover or collect the fixing solution sprayed from first nozzles 21.

Further, in the fixing apparatus 5, the holding groove 25 has the discharge port 25F, and the container 26 is connected to the discharge port 25F, as depicted in FIG. 2.

Thus, the fixing solution held in the holding groove 25 can be collected in the container 26 via the discharge port 25F.

Further, in the fixing apparatus 5, the bottom surface 25E inclines downward in the third direction from the first electrode 22 toward the container 26.

Thus, the fixing solution held in the holding groove 25 is allowed to flow to the container 26 by gravitational force.

Further, in the fixing apparatus 5, the bottom surface 25E inclines downward in the first direction from the one end 24A toward the other end 24B of the second electrode 24, and inclines downward from the other end 24B toward the one end 24A of the second electrode 24 in the first direction.

Thus, the fixing solution held in the holding groove 25 can be collected toward the center portion in the first direction.

As depicted in FIG. 2, the fixing apparatus 5 includes the second nozzles 23 and the second electrode 24. The second electrode 24 faces the second nozzles 23. The second electrode 24 is accommodated in the holding groove 25.

Thus, the fixing solution sprayed from the second nozzles 23 is also guided into the holding groove 25 by the second electrode 24, and held in the holding groove 25.

In the fixing apparatus 5, the second electrode 24 is positioned apart from the bottom surface 25E by being supported by the third support portion 25C and the fourth support portion 25D, as depicted in FIG. 4.

Thus, the fixing solution held in the holding groove 25 can flow between the second electrode 24 and the bottom surface 25E.

As depicted in FIGS. 2 and 5, the fixing apparatus 5 includes the rib(s) 27 between the first electrode and the second electrode in the third direction. The rib(s) 27 guide(s) the print medium S.

As a result, the print medium can be stably conveyed in the third direction.

Further, as depicted in FIG. 2, the distance D5 between the first nozzles 21 and the rib 27 in the second direction is shorter than the distance D1 between the first nozzles 21 and the first electrode 22 in the second direction.

Thus, the print medium S can be guided between the first nozzles 21 and the first electrode 22 in the second direction by use of the rib(s) 27.

According to the fixing apparatus and the image forming apparatus of the present disclosure, the fixing solution sprayed from the nozzles can be recovered or collected.

The invention claimed is:

1. A fixing apparatus configured to fix a toner image on a print medium by spraying a fixing solution on the print medium with the toner image formed thereon, the fixing apparatus comprising:

a plurality of first nozzles from which the fixing solution is sprayed onto the print medium with the toner image formed thereon, and to which voltage is to be applied, a first electrode to which voltage is to be applied, which extends in a first direction, which faces the plurality of first nozzles in a second direction, and which is positioned apart from the plurality of first nozzles in the second direction, a holding groove which accommodates the first electrode, which is configured to hold the fixing solution sprayed from the plurality of first nozzles, and which has a discharge port through which the fixing solution held in the holding groove is discharged, and a container connected to the discharge port and configured to contain the fixing solution discharged from the discharge port, wherein the holding groove has a bottom surface which is positioned on an opposite side of the plurality of first nozzles with respect to the first electrode in the second direction, and which is positioned apart from the first electrode in the second direction so that the fixing solution held in the holding groove passes between the first electrode and the bottom surface to flow toward the discharge port.

2. The fixing apparatus according to claim 1, wherein the discharge port is positioned apart from the first electrode in a third direction orthogonal to the first direction and the second direction.

3. The fixing apparatus according to claim 2, wherein the bottom surface inclines downward in the third direction from the first electrode toward the discharge port.

4. The fixing apparatus according to claim 1, wherein the bottom surface inclines downward in the first direction.

5. The fixing apparatus according to claim 1, wherein the holding groove has a first support portion supporting a first end of the first electrode in the first direction, and a second support portion supporting a second end of the first electrode in the first direction, wherein a first immediate portion of the first electrode positioned between the first end and the second end of the first electrode in the first direction is positioned apart from the bottom surface in the second direction so that the fixing solution held in the holding groove passes between the first electrode and the bottom surface to flow toward the discharge port.

6. The fixing apparatus according to claim 1, wherein the first support portion and the second support portion extend from the bottom surface in the second direction.

7. The fixing apparatus according to claim 1, comprising:

a plurality of second nozzles from which the fixing solution is sprayed onto the print medium with the toner image formed thereon, to which voltage is to be applied, and which are positioned apart from the plurality of first nozzles in a third direction orthogonal to the first direction and the second direction; and a second electrode to which voltage is applied, which extends in the first direction, which is positioned between the plurality of second nozzles and the bottom surface in the second direction, which is positioned apart from the plurality of second nozzles in the second direction, and which is accommodated in the holding groove.

8. The fixing apparatus according to claim 7, wherein the holding groove has a third support portion supporting a first end of the second electrode in the first direction and a fourth support portion supporting a second end of the second electrode in the first direction, a second intermediate portion of the second electrode positioned between the first end and the second end of the second electrode in the first direction is positioned apart from the bottom surface in the second direction so that the fixing solution held in the holding groove passes between the second electrode and the bottom surface to flow toward the discharge port.

9. The fixing apparatus according to claim 8, wherein the plurality of second nozzles are positioned between the plurality of first nozzles and the discharge port in the third direction, the second electrode is positioned between the first electrode and the discharge port in the third direction, and a distance in the second direction between the second intermediate portion of the second electrode and the bottom surface is longer than a distance in the second direction between the first intermediate portion of the first electrode and the bottom surface.

10. The fixing apparatus according to claim 7, the fixing apparatus comprising:

a rib which extends from the bottom surface in the second direction to guide the print medium, and which is positioned between the first electrode and the second electrode in the third direction.

11. The fixing apparatus according to claim 10, wherein an interval in the second direction between the plurality of first nozzles and the rib is shorter than an interval in the second direction between the plurality of first nozzles and the first electrode.

12. The fixing apparatus according to claim 10, wherein the rib includes a plurality of ribs which are arranged in the first direction.

13. An image forming apparatus, comprising:

the fixing apparatus as defined in claim 1, and a photosensitive drum which is rotatable about an axis extending in the first direction, wherein the discharge port is positioned on an opposite side of the photosensitive drum with respect to the first electrode.

* * * * *